US007014020B2

(12) United States Patent
Tamura

(10) Patent No.: US 7,014,020 B2
(45) Date of Patent: Mar. 21, 2006

(54) FOLDING TRAVEL BAG WITH CART

(76) Inventor: Yoshiaki Tamura, 1-8-13 Arai, Icikawa-shi, Chiba, 272-0144 (JP)

( * ) Notice: Subject to any disclaimer, the term of this patent is extended or adjusted under 35 U.S.C. 154(b) by 170 days.

(21) Appl. No.: 10/468,570

(22) PCT Filed: Sep. 26, 2001

(86) PCT No.: PCT/JP01/08374

§ 371 (c)(1),
(2), (4) Date: Aug. 21, 2003

(87) PCT Pub. No.: WO02/071886

PCT Pub. Date: Sep. 19, 2002

(65) Prior Publication Data

US 2004/0069583 A1 Apr. 15, 2004

(30) Foreign Application Priority Data

Feb. 22, 2001 (JP) ..... 2001-046415

(51) Int. Cl.
*A45C 5/14* (2006.01)
*A45C 9/00* (2006.01)

(52) U.S. Cl. ..... 190/15.1; 190/18 A; 190/1; 280/47.371; 280/645

(58) Field of Classification Search ..... 190/1, 190/8, 15.1, 18 A, 108; 260/37, 645, 47.371
See application file for complete search history.

(56) References Cited

U.S. PATENT DOCUMENTS 2,048,553 A * 7/1936 Colvin ..... 190/15.1
3,413,011 A * 11/1968 Weitzner ..... 280/37
3,677,569 A * 7/1972 Larson ..... 280/32.6
D333,725 S * 3/1993 Thomas ..... D3/279
5,820,146 A * 10/1998 Van Ligten ..... 280/87.041
5,984,326 A * 11/1999 Abraham et al. ..... 280/47.2

FOREIGN PATENT DOCUMENTS

| | | |
|---|---|---|
| DE | 3512844 A1 * | 11/1986 |
| EP | 0187183 A2 * | 7/1986 |
| JP | 75575/1987 | 5/1987 |
| JP | 69020/1992 | 6/1992 |
| JP | 62840/1994 | 9/1994 |
| WO | WO-99/44461 | 9/1999 |

* cited by examiner

*Primary Examiner*—Sue A. Weaver
(74) *Attorney, Agent, or Firm*—Jordan and Hamburg LLP

(57) ABSTRACT

A folding travel bag with a cart, which can be used not only as an ordinary travel bag but also as a cart. The folding travel bag includes: a box-shaped travel bag body having a pair of wheels on the bottom face of the body closer to the back: a folding plate having two flat plates connected so that they can be freely folded and borne perpendicularly to the body surface and so that one end of the flat plates is hinged to the lower position on the surface side of the body; a pair of wheels disposed at the leading end portion of said folding plate; and support member extending obliquely upward of the two sides of the body from the two sides of the folding plate. Both the paired wheels on the leading end portion of the folding plate and the paired wheels on the body bottom face are arranged on the floor to bear the body, when the folding plate is folded and brought closer to the side of the body surface or when the folding plate is extended perpendicularly to the body surface.

5 Claims, 5 Drawing Sheets

FOLDING TRAVEL BAG WITH CART

BACKGROUND OF THE INVENTION

1. Field of the Invention

The present invention relates to a folding travel bag with a cart having a folding plate in the lower position of the surface of a travel bag body and wheels in the head portion of the folding plate and in the base portion of the travel bag body, the travel bag being usable as an ordinary travel bag as well as a plain cart.

2. Description of Related Art

Generally, box-shaped travel bags have commonly been used on overseas travel and travel intended for a long stay. Such a travel bag is equipped with four wheels attached to its base portion, so that the travel bag can be conveyed by manually pushing the front or back of the travel bag. However, it is often needed to carry a plurality of pieces of baggage, for example, hand baggage, souvenir bags and so on that cannot be put into the travel bag, together with the travel bag while one is moving in an air port lobby. In such a case as this, the pieces of baggage would have to be carried in several lots or under one's arm and this awkward posture may result in one's backache. In case where the departure time is drawing near in particular, one may be thrown into a panic, which is very dangerous. Though it is of course possible to load a hand cart kept at a railway station with pieces of baggage for conveying purposes, the problem is that there develops trouble in borrowing the hand cart and securing useless time and space resulting from keeping the hand cart.

On the other hand, there is a known cart called a carrying-case formed by providing a frame body having a handgrip with a cloth-made bag. Although this cart is convenient for use as a hand-baggage carrying means, its capacity is too small to be defined as a travel bag for any other purpose. Incidentally, Japanese Utility Model Laid-Open No. 179824/1982 discloses a device for a trunk with a baggage holding stand mounted on its surface and Japanese Utility Model Registration No. 3012425 discloses a device for a bag that can be attached to a cart by means of a band.

However, the problem with the device described in Japanese Utility Model Laid-Open No. 179824/1982 above is that baggage that can be placed and held on the device is limited to an extremely small amount like the conventional carrying-case because a plinth for carrying baggage is provided on one side of the trunk. Further, the device described in Japanese Utility Model Registration No. 3012425 is different from the invention in that the device is not so aimed nor configured as to hold and convey baggage other than the bag because the cart loaded with the bag itself can be conveyed and because the cart can also be contained in the bag when the cart is not in use.

BRIEF SUMMARY OF THE INVENTION

An object of the invention made to solve the foregoing problems is to provide an very convenient folding travel bag with a cart such that even a plurality of pieces of baggage such as golf goods, souvenir bags and so forth can be carried around together with the travel bag; the travel bag is usable as an ordinary travel bag as usual only by folding a folding plate when the cart is not in use; no useless space is required when the travel bag is in one's safekeeping; and the travel bag can easily be carried around during overseas travel.

In order to solve the foregoing problems, a folding travel bag with a cart according to the invention comprises: a box-shaped travel bag body having a pair of wheels on the underside of the travel bag body in a position close to the back of the travel bag body; a folding plate including two flat plates that are retractable and supportable substantially horizontal with respect to the surface of the travel bag body, one end of the flat plate being pivotally attached to the lower position of the surface of the travel bag body; a pair of wheels provided in the head portion of the folding plate; and support means directed obliquely upward from both sides of the folding plate to both sides of the travel bag body, wherein one ends of the support levers are pivotally provided and directed obliquely upward from both sides of the folding plate to both sides of the travel bag body whereby to support the folding plate substantially horizontal with respect to the surface of the travel bag body; the folding plate is folded up by folding down the support levers whereby to pull the folding plate toward the surface of the travel bag body and to fix the folding plate thereto; and when the folding plate is folded up and pulled toward the surface of the travel bag body or when the folding plate is extended substantially horizontal with respect to the surface of the travel bag body, the pair of wheels provided in the head portion of the folding plate and the pair of wheels provided on the underside of the travel bag body are both disposed on the floor surface whereby to support the travel bag body, so that the folding travel bag with the cart is usable as an ordinary travel bag as well as a plain cart.

In order to solve the foregoing problems, further, the folding travel bag with the cart according to the invention is preferably so configured that the support means are foldable support levers and one ends of the support means are pivotally provided and directed obliquely upward from both sides of the folding plate to both sides of the travel bag body whereby to support the folding plate substantially horizontal with respect to the surface of the travel bag body and wherein the folding plate is folded up by folding down the support levers whereby to pull the folding plate toward the surface of the travel bag body and to fix the folding plate thereto.

In order to solve the foregoing problems, further, a folding travel bag with a cart according to the invention comprises: a box-shaped travel bag body having a pair of wheels on the underside of a travel bag body in a position close to the back of the travel bag body; a folding plate including two flat plates that are retractable and supportable substantially horizontal with respect to the surface of the travel bag body, one end of the flat plate being pivotally attached to the lower position of the surface of the travel bag body; a pair of wheels provided in the head portion of the folding plate; and extensible-contractible support levers directed to the upper portions on both sides of the travel bag body from both sides of the folding plate, so that the folding travel bag with the cart is usable as an ordinary travel bag by extending and contracting the support levers to fold up the folding plate and also usable as a cart by extending the folding plate substantially horizontal with respect to the surface of the travel bag body.

In order to solve the foregoing problems, further, the folding travel bag with the cart according to the invention is preferably so configured that the folding plate is formed with two flat plates different in length in the longer direction, wherein one end of the flat plate shorter in length is pivotally attached to the lower position of the surface of the travel bag body, whereas the pair of wheels are provided in the head portion of the flat plate longer in length and wherein in such a condition that the folding plate has been folded up, the wheels are positioned beneath the base portion of the travel bag body and close to the surface of the travel bag body.

In order to solve the foregoing problems, further, the folding travel bag with the cart according to the invention preferably includes a handle that is installed in the back portion of the travel bag body and retainable in its lifted-up position.

In order to solve the foregoing problems, further, the folding travel bag with the cart according to the invention preferably includes a retaining projection provided in the rear of the folding plate on the travel bag body side and when the folding plate is extended substantially horizontal with respect to the surface of the travel bag body, the retaining projection is retained on the underside of the travel bag body.

The pair of wheels are provided in the head portion of the folding plate of the folding travel bag with the cart and when the folding plate is folded up, the travel bag body is movably supported on the floor surface by the wheels provided in the head portion thereof and the pair of wheels provided in the base portion of the travel bag body. When the folding plate is pulled out substantially horizontal with respect to the surface of the travel bag body, the wheels in the head portion of the folding plate are mainly used for supporting the cart portion on the floor surface. The cart portion and the travel bag body are supported substantially horizontally with respect to the floor by the wheels in the head portion of the folding plate and the wheels on the travel bag body side.

The support means directed upward from both sides of the folding plate to both the respective sides of the travel bag body are stretched linearly in such a condition that the folding plate has been pulled out whereby to fix the folding plate substantially horizontal with respect to the surface of the travel bag body. Further, the support levers are set foldable and when the folding plate is folded, the support levers follow the movement of the folding plate, so that the folding plate can be folded up or pulled out without removing the support levers each time the folding plate is folded up.

The extensible-contractible support levers directed upward from both sides of the folding plate to both the respective sides of the travel bag body function as those which support the folding plate substantially horizontal with respect to the surface of the travel bag body and also prevent baggage on the folding plate from slipping off. As the support levers follow the movement of the folding plate, moreover, the folding plate can be folded up or pulled out without detaching the support levers each time the folding plate is folded up.

In the case of the folding plate formed with two flat plates different in length in the longer direction, attaching the wheels to the underside of the head portion of the long flat plate allows the head portion of the folding plate to be projected downward from the base portion of the travel bag body when the folding plate is folded up. Then the wheels attached to the head portion of the folding plate are settled below the travel bag body and seated on the floor surface with substantially the same height of the pair of wheels attached to the travel bag body, whereby the travel bag can be supported substantially horizontally with respect to the floor surface. Moreover, as the wheels attached to the head portion of the folding plate are hidden behind the underside of the folding plate and not seen from the front side, the travel bag offers a good external appearance and also looks nice.

When the folding plate is pulled forward so as to use the cart, the handle fitted to the upper portion of the back of the travel bag body is pulled up and used to hold its course by gripping the handle with the hand. In a case where the folding travel bag with the cart is used as an ordinary travel bag, the handle is pulled down and retained in the back of the travel bag. The handle is thus not any hindrance to the travel bag holder and also makes the travel bag look nice.

The retaining projection provided to the coupling-to-the-body side of the folding plate is retained by the underside of the travel bag body when the folding plate is extended to prevent the folding plate from hanging down further than the underside of the travel bag body and also functions as what fixes the folding plate substantially horizontal with respect to the surface of the travel bag body in cooperation with the function of the support means above. As shown in FIG. 6, moreover, the folding plate is prevented from laterally shaking and can be securely fixed by providing a retaining groove for retaining the projection.

DETAILED DESCRIPTION OF THE INVENTION

Figure 1:
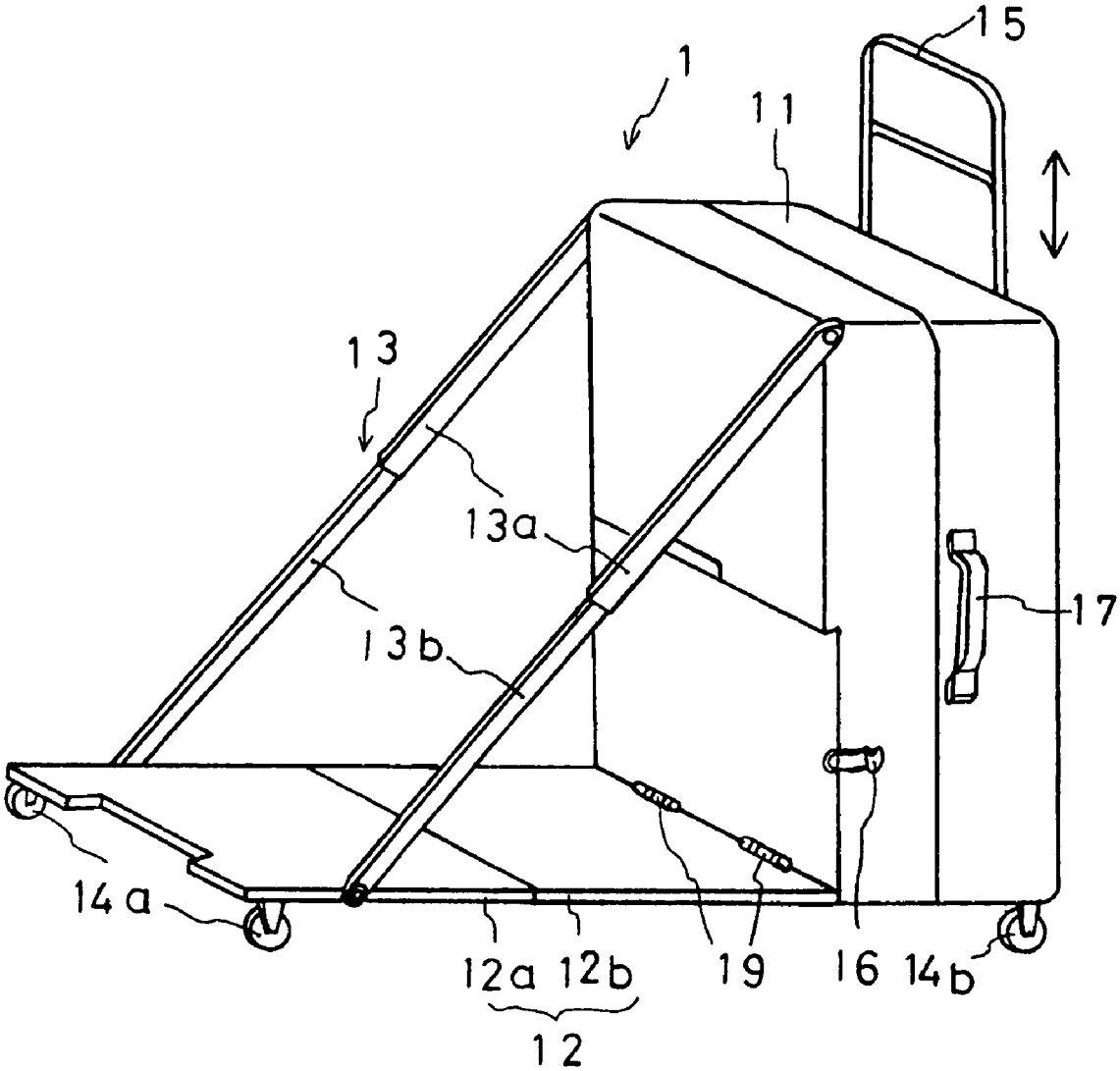
FIG. 1 is a perspective view of a folding travel bag with a cart according to a first embodiment of the invention, illustrating a condition in which the folding plate of the travel bag has been unfolded forward.

Embodiments of the invention will now be described by reference to the drawings. FIG. 1 is a perspective view of a folding travel bag with a cart as a first embodiment of the invention, illustrating a condition in which the folding plate of the travel bag has been unfolded forward and leveled out. In FIG. 1, reference numeral 1 denotes a folding travel bag with a cart; 11, the body of the travel bag; 12, a folding plate; 13, support levers; and 14*a* and 14*b*, front wheels and rear wheels. Material for the manufacture of the folding plate 12 is preferably any one of the light metals including but not limited to aluminum and duralumin. The folding plate 12 may also be fabricated by fitting a synthetic resin plate of such as reinforced plastics into a light metal frame, the reinforced plastics including acrylonitrile butadiene styrene resin (ABS), polycarbonate, fibrous glass reinforced plastic and the like. In other words, light metals, reinforced plastics and any other shock-resistant material are generally usable as materials for travel bags of the sort mentioned above.

The folding plate 12 is mounted to the lower position of the surface of the box-shaped body 11 of the travel bag 1 with the folding cart according to this embodiment of the invention. More specifically, the folding plate 12 is mounted on the surface of the travel bag body 11 with hinges 19, so that the folding plate 12 is pivotal within a substantially vertical-to-horizontal angular range. Further, the folding plate 12 is formed with a front flat plate 12*a* and a rear flat plate 12*b* that are coupled together and is made suspendible from the travel bag body by support levers 13 and 13 for coupling the intermediate parts of the front flat plate 12*a* to the respective upper end parts of the travel bag body. Both the flat plates are coupled together by means of hinges 19 bolted onto the underside of them. Further, both the flat plates overlap each other or the lateral edges of them are brought into contact with each other and made pivotable to the extent that both the flat plates level out in substantially the same plane. In this case, the joint between the front flat plate 12*a* and the rear flat plate 12*b* may be reinforced by reinforcing material or auxiliary wheels may also be provided near the joint (not shown).

Figure 4:
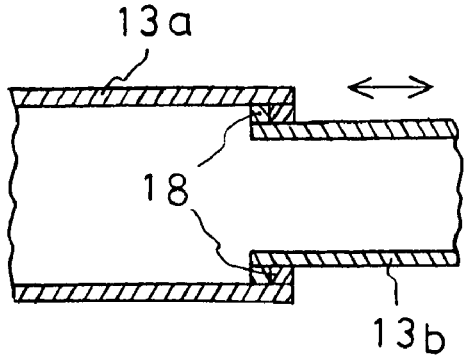
FIG. 4 is an enlarged vertical sectional view illustrating a condition in which an upper support lever and a lower support lever are latched together.

The front flat plate 12*a* for partially forming the folding plate 12 is slightly longer than the rear flat plate 12*b* and provided with a cutout portion in front. A pair of front wheels 14*a* and 14*a* are attached to the underside of the front flat plate with the cutout portion held therebetween. Each of the support levers 13 and 13 has an upper support lever 13*a* and a lower support lever 13*b* that are metal pipes rectangular in cross section and the lower support lever 13*b* is slidably inserted into the upper support lever 13*a*. As shown in FIG. 4 by way of example, retaining projections 18 and 18 respectively formed on the inner side of the front portion of the upper support lever 13*a* and the outer side of the front portion of the lower support lever 13*b* latch each other so as to prevent both the pipes from coming out.

Figure 2:
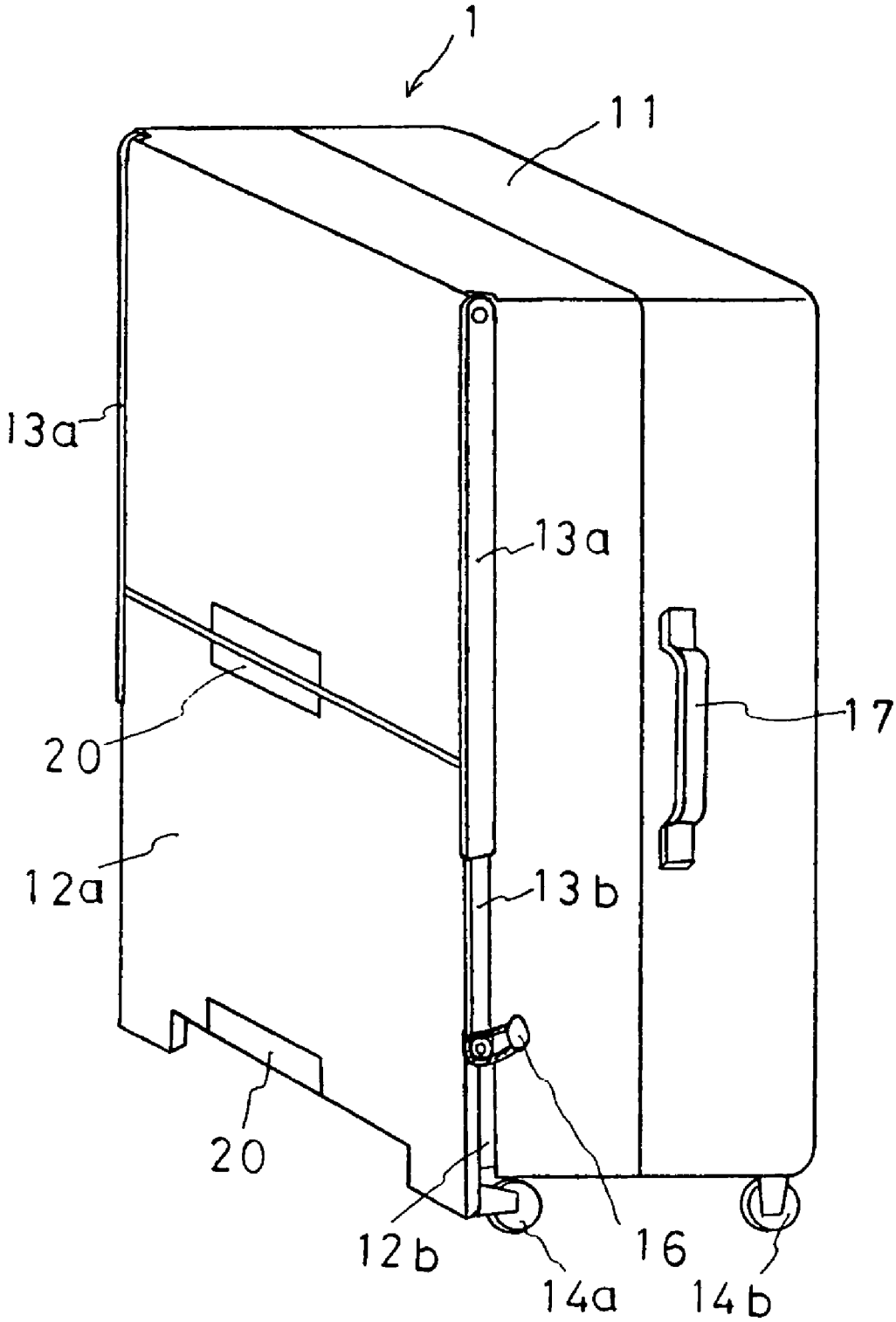
FIG. 2 is a perspective view of the folding travel bag with the cart according to the first embodiment of the invention, illustrating a condition in which the folding plate of the folding travel bag with the cart has been folded up and joined to the surface of the travel bag body.
Figure 3:
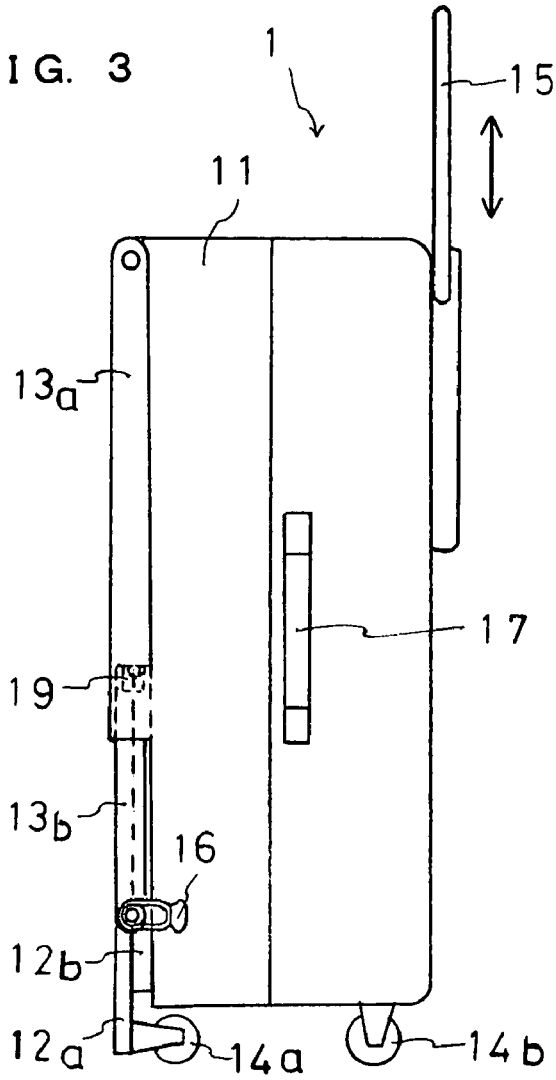
FIG. 3 is a side view of the folding travel bag with the cart according to the first embodiment of the invention, illustrating the condition in which the folding plate of the folding travel bag with the cart has been folded up and joined to the surface of the travel bag body.

FIGS. 2 and 3 show a condition in which the folding plate 12 of the travel bag 1 with the folding cart according to this embodiment of the invention has been folded up and joined to the surface of the travel bag body 11. When the folding plate 12 is completely joined to the surface of the travel bag body 11, the front wheels 14*a* attached to the head portion of the folding plate 12 are retreated under the travel bag body 11, whereby the front wheels 14*a* together with the rear wheels 14*b* of the travel bag body 11 support the travel bag 1 on the floor surface. There is formed a difference in level between the upper and lower portions of the surface of the travel bag body 1 and a depression in the lower portion thereof is great enough to receive the folded plate 12, so that after the folding plate 12 is completely joined to the surface thereof, the upper portion is level with that of the lower portion in substantially the same plane.

When the folding plate 12 is folded up and completely joined to the surface of the travel bag body, the intermediate parts of the lower support levers 13*b* of the right and left support levers 13 are inserted into the respective upper support levers 13*a*, both the support levers 13 being retained vertically along both the right and left edges of the surface of the travel bag body. Consequently, both the support levers 13 serve as bolts to prevent the folding plate 12 from being unfolded spontaneously after the folding plate 12 is completely joined to the travel bag body. Nevertheless, a safety means for preventing the folding plate 12 from being unfolded unexpectedly, for example, a latching device 16 for clamping the head portion of the retaining pivot of the lower support lever 13*b* to the travel bag body may be provided on the side of the travel bag body. Moreover, an S-to-N pole magnet 20 may be attached to the surface portion of the travel bag body 11 and the folding plate 12.

Figure 5:
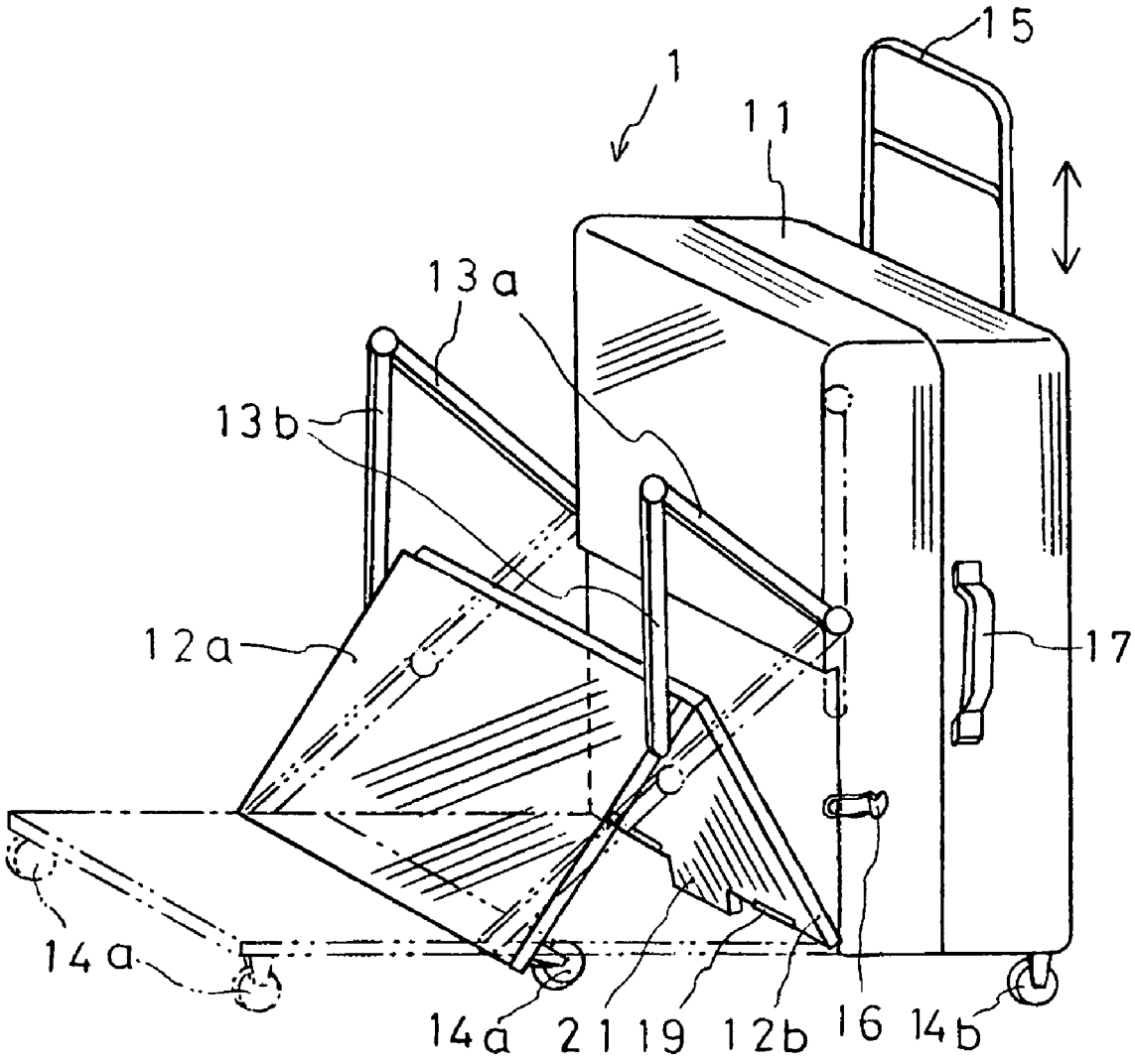
FIG. 5 is a perspective view illustrating the folding plate of a folding travel bag with a cart and foldable support levers for supporting the folding plate according to a second embodiment of the invention.

Subsequently, a second embodiment of the invention will be described by laying emphasis on an arrangement different from that of the first embodiment thereof. FIG. 5 is a perspective view of a folding travel bag with a cart according to this embodiment of the invention, illustrating a folding plate and foldable support levers for supporting the folding plate. In this second embodiment of the invention, foldable support levers 13 are provided in place of the extensible-contractible support levers 13 in the first embodiment thereof. The folding travel bag with the cart according to this embodiment of the invention is substantially similar in construction to the travel bag according to the first embodiment thereof except that a projected retaining portion 21 is provided on the travel bag body side of the rear flat plate 12*b* of the folding plate 12 and that a retaining groove 22 for retaining the projected retaining portion 21 is provided in the travel bag body. Hence, like elements are given like reference characters and the description thereof will be omitted.

The upper support levers 13*a* and the lower support levers 13*b* of the foldable support levers 13 are pivotally connected and when tensile force or pushing pressure is applied to these support levers as the support levers become linear, the upper support levers 13*a* and the lower support levers 13*b* function as those maintain the linear condition, whereby the folding plate 12 is prevented from vertically pulsating. It is preferably arranged to connect the upper support lever 13*a* and the lower support lever 13*b* at one fulcrum by, for example, caulking or screwing them up or the like and to provide a small projection on the contact surface of both the support levers so that these levers maintain the linear condition (not shown). One ends of the two upper support levers 13*a* and 13*a* are pivotally provided near the middle points of the respective close-to-surface sides of the travel bag body 11, whereas one ends of the two lower support levers 13*b* and 13*b* are pivotally provided on both the respective sides near the coupling portion of the front flat plate 12*a*.

Figure 6:
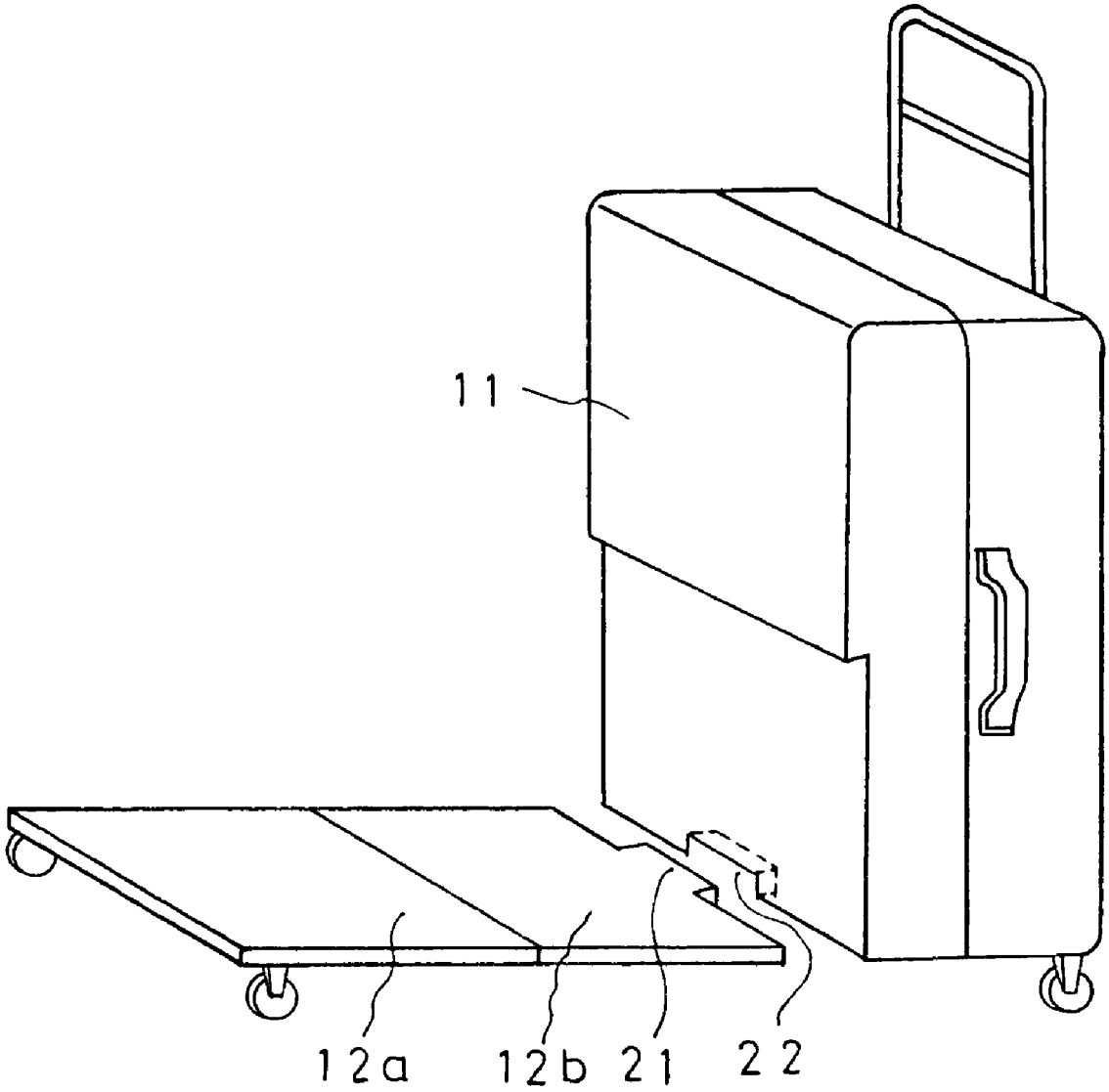
FIG. 6 is a perspective view illustrating the folding plate of the folding travel bag with the cart and a retaining projection and a retaining groove provided in the travel bag body according to the second embodiment of the invention.

The projected retaining portion 21 provided at the back of the rear flat plate 12*b* may be formed integrally with the rear flat plate 12*b* or otherwise the projected retaining portion 21 formed separately from the rear flat plate 12*b* may be joined by, for example, welding to the rear of the rear flat plate 12*b*. The projected retaining portion 21 and the rear flat plate 12*b* are normally formed in the same plane. On the other hand, as shown in FIG. 6, the retaining groove 22 for receiving the projected retaining portion 21 is provided in the underside portion of the travel bag body 11 and the folding plate 12 is pivotally attached to the lowermost part of the surface of the travel bag body by means of hinges 19 in such a condition that the projected retaining portion 21 has been fitted in the retaining groove 22. Moreover, the folding plate 12 can be attached to the travel bag body 11 without using the retaining groove 22 so that the surface of the projected retaining portion 21 is directly retained in the underside portion of the travel bag body 11.

A description will now be given of an exemplary use of the travel bag 1 with the folding cart according to the second embodiment of the invention. When the above travel bag is used as a cart, first, there follow the steps of unlocking the latching device 16 as a safety means if any, extending the folding plate 12 until it levels out by manually pulling out the lower portion of the front flat plate 12*a* and lifting up the handle 15. As the cart is thus ready for use, baggage is loaded on the folding plate 12 and conveyed by pushing the handle 15 from behind. The above procedure is reversed by folding up the folding plate 12 and lifting down the handle 15 along the back of the travel bag body. Consequently, the travel bag 1 can needless to say be conveyed as an ordinary travel bag by manually pushing the front or back of the travel bag or griping its handgrip 17.

The travel bag 1 with the folding cart according to the second embodiment of the invention is similarly usable like the travel bag 1 with the folding cart according to the first embodiment thereof. In other words, the folding plate 12 can simply be folded up by pulling the folding plate 12 close to the travel bag body by folding down the support levers 13. The support members of the folding plate of the travel bag 1 with the folding cart according to the invention are not limited to those illustrated according to the embodiments of the invention but may be in the form of a chain or cord. Moreover, reinforcing ribs may be formed in the head portion or peripheral edge portion of the folding plate in order to prevent the baggage loaded on the cart from slipping off.

The folding travel bag with the cart so configured as described above according to either first or second embodiment of the invention has the effect of making itself not only usable as an ordinary travel bag but also simply convertible into a cart for safely conveying pieces of hand baggage, souvenir bags and so forth only by pulling the folding plate forward without any troublesome work. While the cart is not in use, it can be reduced to convenient size only by folding up the folding plate and requires no useless space, whereby the travel bag can easily be carried around regardless of overseas or domestic travel. The reason for the provision of the retaining projection on the folding plate is to stabilize baggage on the cart and to prevent the baggage from tumbling down as the blurring of the folding plate is prevented to ensure that the folding plate is fixed on properly.

The invention claimed is:

1. A folding travel bag with a cart comprising:

a box-shaped travel bag body having a first pair of wheels on an underside of the travel bag body in a position close to a back portion of the travel bag body;

a folding plate including two flat plates that are retractable and supportable by and projecting from a side surface of the travel bag body, a first end portion of the folding plate being pivotally attached to a lower position of the side surface of the travel bag body, a second pair of wheels provided on a second end portion of the folding plate; and foldable support levers directed obliquely upward from sides of the folding plate to sides of the travel bag body, wherein ends of the support levers are pivotally provided and directed obliquely upward from said sides of the folding plate to said sides of the travel bag body to support the folding plate, wherein the folding plate is folded up by folding down the support levers to pull the folding plate toward the side surface of the travel bag body, and wherein when the folding plate is folded up and pulled toward the side surface of the travel bag body and when the folding plate is extended, the pair of wheels provided in said second end portion of the folding plate and the pair of wheels provided on the underside of the travel bag body are disposed on a floor surface to rollably support the travel bag body.

2. A folding travel bag with a cart comprising:

a box-shaped travel bag body having a first pair of wheels on an underside of the travel bag body in a position close to a back portion of the travel bag body;

a folding plate including two flat plates that are retractable and supportable by and projecting from a side surface of the travel bag body, a first end portion of the folding plate being pivotally attached to a lower position of the side surface of the travel bag body; a second pair of wheels provided in a second end portion of the folding plate;

and extensible-contractible support levers directed obliquely upward from sides of the folding plate to sides of the travel bag body, and wherein when the folding plate is folded up and pulled toward the side surface of the travel bag body and when the folding plate is extended, the air of wheels provided in said second end portion of the folding plate and the pair of wheels provided on the underside of the travel bag body are disposed on a floor surface to rollably support the travel bag body.

3. A folding travel bag with a cart as claimed in either claim 1 or claim 2, wherein said two flat plates are of different lengths in a direction extending from said travel bag body, an end portion of the flat plate shorter in length is pivotally attached to the lower position of the side surface of the travel bag body, the second pair of wheels are provided on an underside of an end portion of the flat plate longer in length, and the second pair of wheels are positioned beneath a base portion of the travel bag body and close to the surface of the base portion thereof when the folding plate has been folded up.

4. A folding travel bag with a cart as claimed in either claim 1 or claim 2, including a handle which is retractable as a result of vertically extending and contracting the handle, irrespective of movement of the folding plate, and retainable in a lifted-up position.

5. A folding travel bag with a cart as claimed in either claim 1 or claim 2, further including a retaining projection provided in an end portion of the folding plate, wherein when the folding plate is extended, the retaining projection engages the underside of the travel bag body.

* * * * *